US006640757B2

(12) United States Patent
Uchida

(10) Patent No.: US 6,640,757 B2
(45) Date of Patent: Nov. 4, 2003

(54) VARIABLE VALVE DRIVE MECHANISM FOR AN INTERNAL COMBUSTION ENGINE

(75) Inventor: Masahiro Uchida, Iwata (JP)

(73) Assignee: Yamaha Hatsudoki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/065,831

(22) Filed: Nov. 22, 2002

(65) Prior Publication Data

US 2003/0101949 A1 Jun. 5, 2003

(30) Foreign Application Priority Data

Nov. 30, 2001 (JP) ..... 2001-367102

(51) Int. Cl.[7] ..... F01L 9/02

(52) U.S. Cl. ..... 123/90.12; 123/90.15; 123/90.17; 123/193.5

(58) Field of Search ..... 123/90.12, 90.11–90.18, 123/90.27, 90.31, 90.38, 193.2, 193.3, 193.5; 92/161

(56) References Cited

U.S. PATENT DOCUMENTS

| | | | | | |
|---|---|---|---|---|---|
| 6,035,817 | A | * | 3/2000 | Uchida | 123/90.17 |
| 6,186,105 | B1 | * | 2/2001 | Yonezawa | 123/90.17 |
| 6,289,861 | B1 | | 9/2001 | Suzuki | 123/90.17 |
| 6,302,071 | B1 | * | 10/2001 | Kobayashi | 123/90.16 |

* cited by examiner

*Primary Examiner*—Thomas Denion
*Assistant Examiner*—Kyle Riddle
(74) *Attorney, Agent, or Firm*—Ernest A Beutler

(57) ABSTRACT

An improved arrangement for controlling the valve operation of an internal combustion engine wherein the control valves are mounted within perpendicularly extending bores formed in the cylinder head and camshaft bearing cap with the bores being deep enough so that the valves do not project significantly beyond the cylinder head. In addition, one or more of the connecting passages are formed by grooves in the mating surfaces of the cylinder head and bearing cap to avoid the necessity of drillings and particularly of drilling blind bores.

21 Claims, 4 Drawing Sheets

VARIABLE VALVE DRIVE MECHANISM FOR AN INTERNAL COMBUSTION ENGINE

BACKGROUND OF INVENTION

This invention relates to an internal combustion engine and more particularly to an improved, compact and easily manufactured, variable valve driving mechanism for such engines.

In order to improve the performance of internal combustion engines throughout their entire load and speed ranges, it has been proposed to employ a variable valve actuating mechanism that will vary the timing of one or more of the camshafts of the engine relative to the engine crankshaft and/or the degree of lift of the valve. By changing the valve timing and/or lift, it is possible to improve the performance for a variety of specific running conditions.

Conventionally, the variable valve timing mechanisms have employed some form of phase shifting mechanism in the drive of the camshafts so as to achieve the variation in the valve timing. These mechanisms are normally hydraulically operated and employ control valves that are mounted on the engine and which supply controlling pressure to the variable valve timing mechanism. Also the amount of valve lift can also be varied hydraulically.

Generally these control valves are comprised of a valve spool and a valve actuator, normally in the form of an electrically operated solenoid. It has been the practice to mount these valves in proximity to the camshafts so as to simplify the plumbing associated therewith and to avoid pressure losses.

One way this may be done is as shown in U.S. Pat. No. 6,289,861, assigned to the assignee hereof. As shown in that patent, the control valves are mounted so that they extend perpendicularly to the mating faces of the cylinder head and cam caps and in close proximity thereto. As shown in that patent, this results in, the positioning of the actuating solenoid in a vertically upstanding position and projecting substantially through the cam cover for the engine. Although this is acceptable in some applications, in many engine applications such projections are undesirable.

It is, therefore, a principal object to this invention to provide an improved actuating control valve mechanism for the variable valve actuating arrangement of an internal combustion engine.

It is another object to this invention to provide an improved and compact arrangement for mounting the control valve of a variable valve actuating mechanism for an internal combustion engine.

Normally the control valve receives oil from the engine lubricating system and delivers it through passages formed in the cylinder head and/or cam bearing cap to communicate with the variable valve actuating mechanism through passages that are formed in the camshaft and generally extend longitudinally there through. This requires the provisions of several passages including a supply passage and a return passage. The supply passage communicates to one of two chambers of the variable valve actuating mechanism and the return passage is connected to the other of these chambers of the valve actuating mechanism. The pressure in these chambers is varied to change the position of the variable valve timing mechanism to achieve the change in valve timing and/or lift.

Obviously, the provision of these multiple passages presents some problems and generally it has been the practice to form the passages primarily through drillings in the various engine components. This can give rise to several difficulties and also is costly.

It is, therefore, a still further object to this invention to provide an arrangement for the control valve communication with the variable valve timing mechanism wherein at least some of the supply passages can be formed in the interface between mating components without requiring drilling.

SUMMARY OF INVENTION

The features of the invention are adapted to be embodied in an internal combustion engine comprised of a cylinder head member adapted to be affixed in closing relation with at least one cylinder bore to form a variable volume combustion chamber with a piston reciprocating in the cylinder bore. At least one valve is supported for reciprocation in the cylinder head for serving the combustion chamber. A camshaft is journalled in the cylinder head and a cam cap that is affixed to the cylinder head for operating the valve. A hydraulically operated variable valve actuating mechanism operates the valves from an engine driven shaft and varies the timing and/or lift thereof. A control valve selectively controls the operation of the hydraulically operated variable valve actuating mechanism. The control valve has a spool portion and an operating portion for effecting reciprocation of the spool portion.

In accordance with a first feature of the invention, a fitting opening extends through the cam cap and is aligned with a corresponding fitting opening in the cylinder head. The fitting openings have their axes extending perpendicularly to facing and abutting surfaces of the cam cap and the cylinder head. The control valve is disposed in substantial part in the fitting openings with only a small portion of the control valve operating portion extending through an opening in an associated cam cover and outwardly of the area enclosed thereby.

In accordance with another feature of the invention, the control valve supplies fluid to and exhausts fluid from the variable valve timing mechanism through a plurality of passages formed in the internal combustion engine. At least one of these passages is formed by a recess formed in facing and abutting surfaces of the cam cap and the cylinder head.

DETAILED DESCRIPTION

Figure 1:
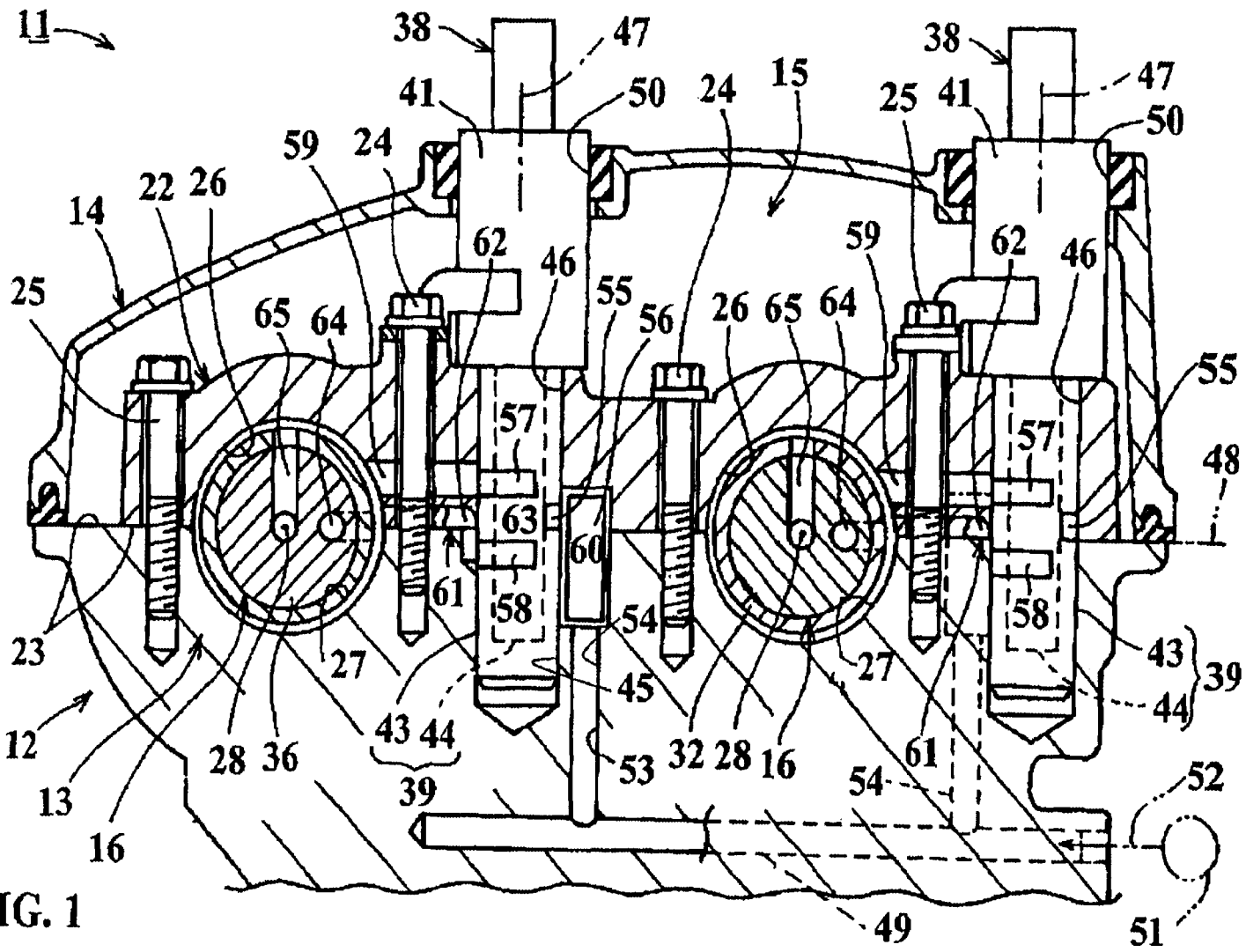
FIG. 1 is a cross sectional view taken along the line 1—1 of FIG. 2 and through the upper portion of one bank of an internal combustion engine constructed in accordance with an embodiment of the invention.

Referring now in detail to the drawings, an internal combustion engine constructed in accordance with an embodiment of the invention is indicated generally by the reference numeral 11 and is shown only partially. That is, only the cylinder head assembly, indicated generally by the reference numeral 12, of one bank of a V-type engine is illustrated because the invention deals primarily with the variable valve timing mechanism for the engine. Therefore, where any components of the engine 11 are not illustrated, those skilled in the art will readily understand that the construction may be of any desired or known type.

As noted, the engine 11 is of the V-type and for the aforenoted reasons only one cylinder bank is shown. It will be readily apparent to those skilled in the art that the invention can be utilized with engines having other configurations and with any number of cylinders. Also, the engine 11 is primarily intended for use in a vehicle such as an automobile or motorcycle and thus, must have a compact construction.

The cylinder head assembly 12 is comprised of a main cylinder head member, indicated generally by the reference numeral 13, and which is formed from a suitable material such as aluminum or an aluminum alloy. A cam cover 14 is detachably affixed to the cylinder head member 13 in a known manner and encloses a cam chamber 15 in which the valve actuating mechanism, now to be described, is positioned.

Figure 2:
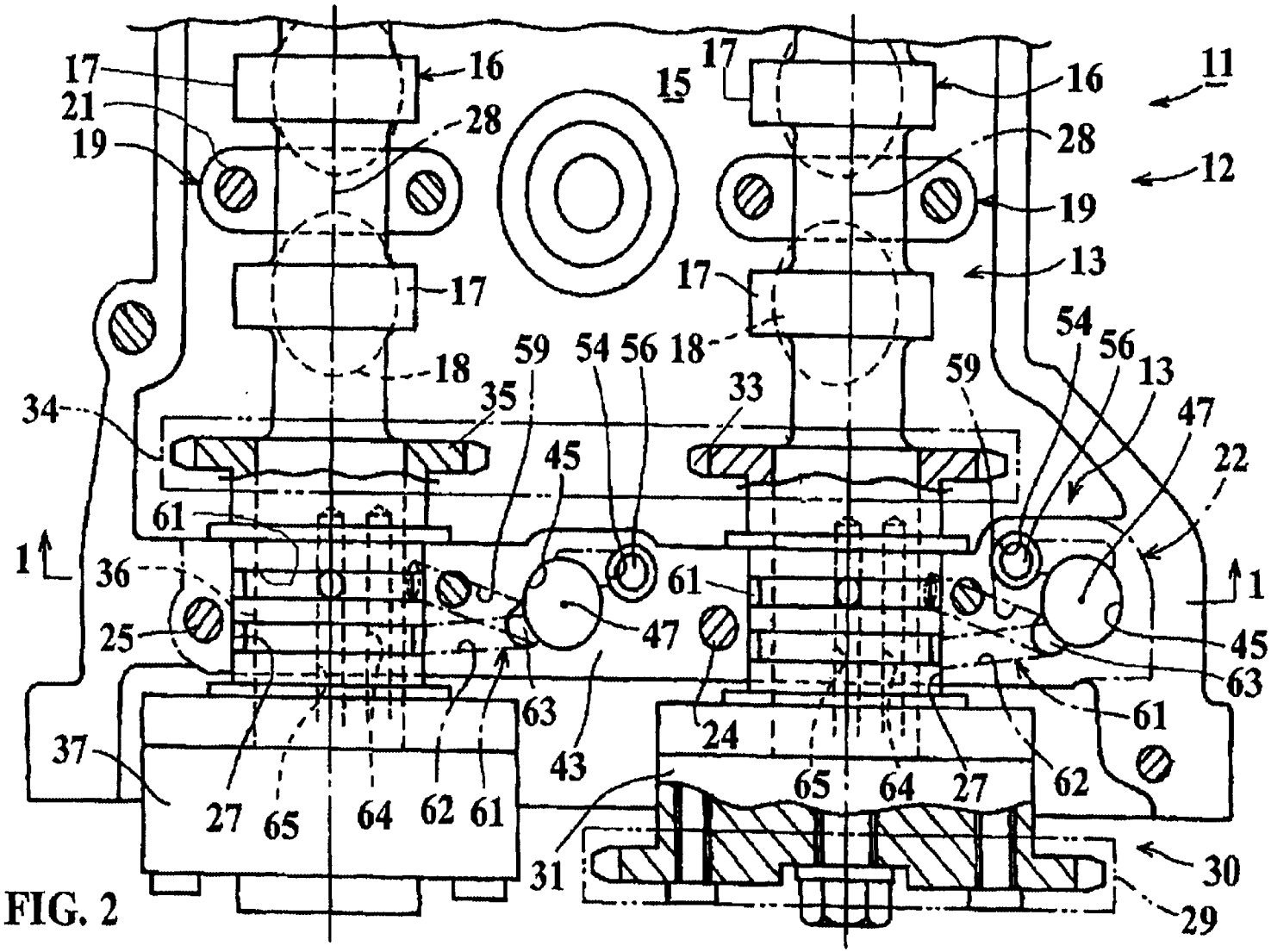
FIG. 2 is a top plan view of the cylinder head illustrated in FIG. 1 with the cam cover removed and portions broken away so as to more clearly show the construction.
Figure 3:
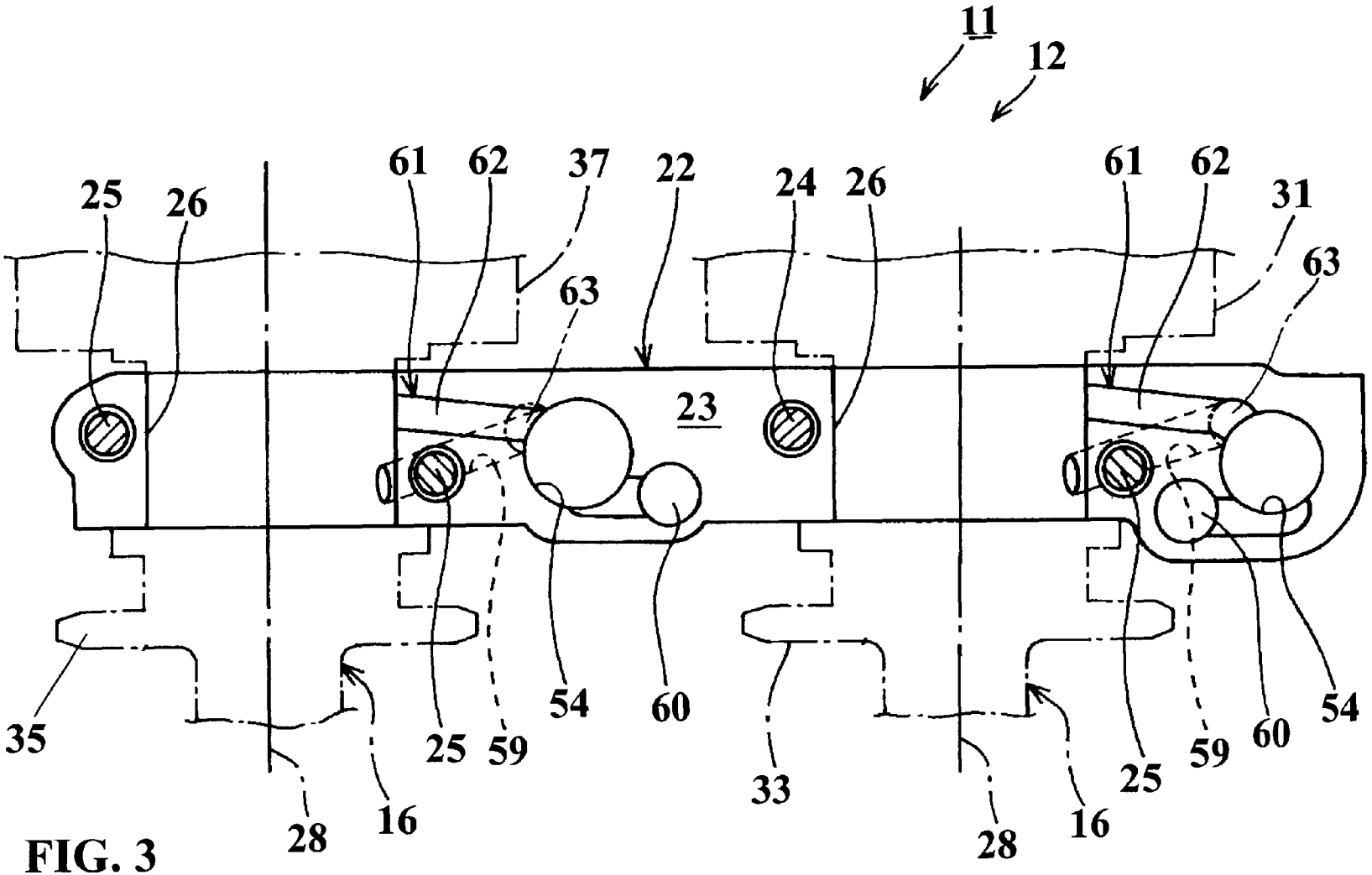
FIG. 3 is a bottom view of the cam cap with the camshafts shown in phantom.
Figure 4:
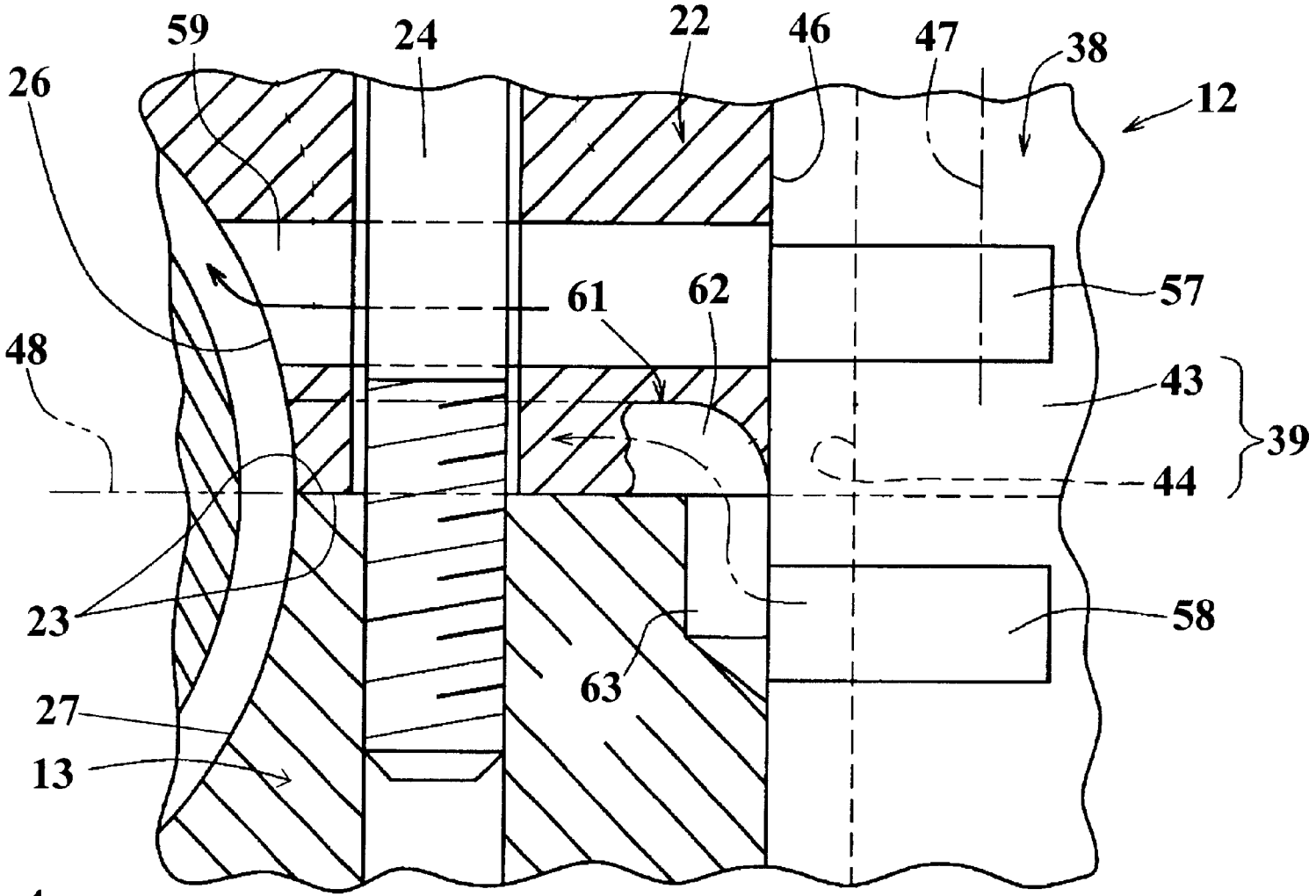
FIG. 4 is a further enlarged cross sectional view looking in the same direction and taken along the same plane as FIG. 1 and shows the lubricant flow path from the control valve.

As may be best seen in FIGS. 1 and 2, there are journalled in the cylinder head assembly 12 a pair of camshafts, each indicated generally by the reference numeral 16, and one of which forms.an intake camshaft and the other which forms an exhaust camshaft. As seen in FIG. 2, each of these camshafts 16 is provided with a plurality of pairs of cam lobes 17 each associated with a respective cylinder of the engine for operating a respective pair of valves through thimble tappets 18. In other words, the engine 11 is of the four valve per cylinder type. Although this type of valve actuating mechanism is described, it will be readily apparent to those skilled in the art that other forms of valve actuation and valve layouts can be employed in accordance with the invention.

The camshafts 16 and 17 are journal led in the cylinder head assembly 12 and specifically at spaced locations along their length by bearing caps 19 that are disposed between adjacent cam lobes 17 and which are affixed to the main cylinder head member 13 by threaded fasteners 21 in a manner well known in the art.

In accordance with the invention, there is further provided adjacent the forward ends of the camshafts 16 a common forward or main bearing cap 22 by which the ends of the cam shafts 16 are journaled in a manner that will be described shortly. This main bearing cap 22 and the cylinder head member 13 have facing surfaces 23 that are held in abutting engagement. This is accomplished by pairs of threaded fasteners at each side comprised of threaded fasteners 24 and 25. These threaded fasteners 24 and 25 are threaded into appropriate tapped holes formed in the cylinder head member 13.

Between the threaded fasteners 24 and 25, the main bearing cap member 22 has bearing surfaces 26 that engage bearing surfaces for the camshaft 16. In a like manner, the cylinder head member 13 is provided with complimentary bearing surfaces 27. The rotational axes of the camshafts 16 defined by these bearing surfaces 26 and 27 are indicated by the center lines 28.

Although any type of arrangement may be employed for transmitting drive from the engine crankshaft or another shaft or shafts which are rotated in time with the crankshaft, a timing drive, indicated generally by the reference numeral 30 is illustrated as one of many with which the invention can be utilized. This includes an engine shaft driven chain 29 that is entrained around a driven sprocket 31 fixed, in a manner to be described, to the camshaft 16 adjacent the valley between the cylinder banks.

This driven sprocket 31 includes a variable valve timing (VVT) mechanism of any suitable, hydraulically operated type so that the relative angular relationship of the camshaft 16 can be adjusted, in a manner to be described shortly. In addition, the sprocket 31 has a sleeve portion 32 which encircles the forward portion of the camshaft 16 and which terminates at its rear end in a driving sprocket 33.

This driving sprocket 33 is contained within the valve chamber 15 and drives a timing chain 34 from which a further sprocket 35 is driven. The sprocket 35 has a cylindrical portion 36 which encircles the remaining camshaft 16 is journaled in the bearing cap 27. At its forward end, this sprocket cylindrical portion 36 drives a second variable valve timing mechanism 37 by which the timing relationship of the associated camshaft 16 can be varied. In other words, the variable valve timing mechanism in the sprocket 31 drives and controls the timing of the right hand camshaft 16 shown in the figures while the variable valve timing mechanism 37 drives and controls the timing of the remaining of the camshafts 16.

The variable valve timing mechanisms 31 and 37 each are of a type that employ a pair of hydraulic chambers which are selectively pressurized or communicated with a return to the oil reservoir in order to provide the axial shifting necessary to change the relative rotational position of the associated camshaft 16 relative to the engine crankshaft. The actual construction of these variable valve timing mechanisms can be of any known type and the invention deals primarily with the control valves for controlling their operation, indicated generally by the reference numeral 38 and the manner in which hydraulic fluid is delivered to and from these control valves.

Each control valve 38 is comprised of a lower valve portion 39 and an upper actuation portion 13. The valve portion 39 includes a cylindrical sleeve 43 mounted in the cylinder head assembly 12 in a manner to be described and a sliding spool valve element 44. As has been previously noted, the actuators 41 may be electrical solenoids which actuate the valve elements 44.

Each valve portion 39 is mounted in a pair of aligned bores formed in the cylinder head member 13 and the main cam bearing cap 22. These bores are indicated by the reference numerals 45 and 46, respectively. These bores 45 and 46 collectively define a respective axis 47 that extends perpendicularly to a plane, indicated by the dot dash line 50 which passes through the mating surfaces 23 of the bearing cap 22 and cylinder head member 13. The axes of rotation 28 of the camshafts 16 also lie on this plane.

The bores 45 and 46 are spaced low enough in the cylinder head member 13 so that only the upper peripheral edge of the actuating portion 41 extends through openings in the cam cover 14 that are sealed by sealing rings 48. Thus, a very compact assembly is provided. A terminal end of the valves 38 is disposed externally of the cam cover 14 to receive a suitable electrical connector to transmit the control signals to the solenoid actuator 41.

The oil supply to the control valves 38 will now be described. As is typical, the VVT mechanism contained within the elements 31 and 37 are operated by the lubricant from the engine and hence, an oil supply manifold 49 is crossed drilled through the cylinder head member 13 below the camshaft axes 28. This communicates in a suitable manner with the engine oil pump, indicated schematically at 51, through a conduit or conduits which are indicated schematically at 52.

Cross drilled from the cylinder head surface 23 is a pair of supply passages consisting of lower smaller diameter portions 53 and upper larger diameter portions 54 with these upper portions extending to the cylinder head surface 23. The upper bore portions 54 intersect the bores 45 of the cylinder head member 13 in which the valve sleeve 43 is positioned so as to communicate directly with inlet openings 55 formed in these valve sleeves 43 that cooperate with the lands on the valve spools 44. This is true only at one side as i.e. the left hand side. The passage 55 at the other side communicates appropriately with the bore portion 54. Removable oil filters 56 are positioned in recesses 60 formed in the cam bearing cap 22 for ease of servicing. That is, the filters 56 can be removed for cleaning or replacement merely by removing the bearing cap 22.

A pair of passages 57 and 58 is formed along the length of the opposite sides of the valve sleeves 43 and these communicate with passages formed in the manner now to be described. First, there is an upper passage 59 formed by a drilling solely in the bearing cap 22 and this communicates with the bearing surface 26 formed therein and with a circumferential groove formed in the respective sleeve 32 and 36 and camshaft 16. These grooves are shown in FIG. 2 and are identified by the reference numeral 61.

The remaining passage is formed by a semi cylindrical, grooved passage, indicated by the reference numeral 61 and which is formed in the under surface 23 of the bearing cap 22 by a suitable machining operation, thus avoiding the necessity of drilling. The end of this slot 61 has a reducing diameter curved portion 62 which, in turn, communicates with a vertical passage 63 formed in the cylinder head member 13 and which communicates with the slot 57.

The camshafts 16 each have a pair of longitudinally extending bores 64 and 65 which extend axially there through and communicate in a known manner with the variable valve timing mechanisms in the members 31 and 37.

Not shown is a dump or return passage which is formed in the engine body so as to return oil from the selected one of the chambers back to the oil reservoir of the engine.

The control valves 38 are rigidly mounted to the cylinder head assembly and specifically to the bearing caps 22 by the threaded fasteners 24 or 25 and appropriate projections formed on the body of the valve portions 41.

Thus, from the forgoing description it should be readily apparent that the described construction is not only compact but also greatly simplifies the formation of the passages for delivering and returning fluid from the VVT mechanisms and the engine lubricating system or other actuating oil supply. Although the embodiment specifically disclosed varies the valve timing, it should be readily apparent that the invention can also be employed with arrangements for varying the degree of valve lift or in systems where both timing and lift are hydraulically altered. Of course, the foregoing description is that of a preferred embodiment of the invention and various changes and modifications may be made without departing from the spirit and scope of the invention, as defined by the appended claims.

What is claimed is:

1. An internal combustion engine comprised of a cylinder head member adapted to be affixed in closing relation with at least one cylinder bore to form a variable volume combustion chamber with a piston reciprocating in said cylinder bore, at least one valve supported for reciprocation in said cylinder head for serving said combustion chamber, a camshaft journalled in said cylinder head and a cam bearing cap affixed to said cylinder head for operating said valve, a hydraulically operated variable valve actuating mechanism for actuating said valve from said cam shaft, a control valve for selectively controlling the operation of said hydraulically operated variable valve actuating mechanism, said control valve having a spool portion and an operating portion for effecting reciprocation of said spool portion, a fitting opening extending through said cam bearing cap and aligned with a corresponding fitting opening in said cylinder head member, said fitting openings having their axes extending perpendicularly to facing and abutting surfaces of said cam bearing cap and said cylinder head, said control valve being disposed in substantial part in said fitting openings.

2. An internal combustion engine as set forth in claim 1, wherein the control valve is affixed to the cam bearing cap.

3. An internal combustion engine as set forth in claim 2, wherein the control valve is affixed to the cam bearing cap by a threaded fastener that fixes the cam bearing cap to the cylinder head member.

4. An internal combustion engine as set forth in claim 1, wherein the cam shaft has longitudinally extending passages for control fluid communication between the control valve and the hydraulically operated variable valve actuating mechanism.

5. An internal combustion engine as set forth in claim 4, wherein the control valve communicates with the cam shaft longitudinally extending passages through passages formed in at least one of the cylinder head member and the bearing cap member.

6. An internal combustion engine as set forth in claim 5, wherein at least one of the passages formed in at least one of the cylinder head member and the bearing cap member is not a drilled passage.

7. An internal combustion engine as set forth in claim 6, wherein the passage that is not drilled is formed by a groove in the abutting face of one of the cylinder head member and the cam bearing cap.

8. An internal combustion engine as set forth in claim 7, wherein the passage that is not drilled is formed in the abutting face of the cam bearing cap.

9. An internal combustion engine as set forth in claim 8, wherein passages that terminate with the cam shaft longitudinally extending passages are all formed in the bearing cap member.

10. An internal combustion engine as set forth in claim 5, wherein at least one of the passages formed in at least one of the cylinder head member and the bearing cap member extends through said cylinder head member from an oil supply and terminates in a closed ended bore in said bearing cap member in which an oil filter is positioned and can be serviced by removing said bearing cap member.

11. An internal combustion engine as set forth in claim 1, wherein a cam cover is affixed to the cylinder head and encloses the cam cap, the control valve extending only slightly through said cam cover.

12. An internal combustion engine as set forth in claim 11, wherein the variable valve actuating mechanism varies the timing between the cam shaft and the engine driven shaft.

13. An internal combustion engine comprised of a cylinder head member adapted to be affixed in closing relation with at least one cylinder bore to form a variable volume combustion chamber with a piston reciprocating in said cylinder bore, at least one valve supported for reciprocation in said cylinder head for serving said combustion chamber, a camshaft journalled in said cylinder head and a cam cap affixed to said cylinder head for operating said valve, a hydraulically operated variable valve actuating mechanism for operating said valve from said cam shaft, a control valve for selectively controlling the operation of said hydraulically operated variable valve actuating mechanism, said control valve having a spool portion and an operating portion for effecting reciprocation of said spool portion, said control valve supplies fluid to and exhausts fluid from said variable valve timing mechanism through a plurality of passages formed in said internal combustion engine, at least one of these passages is formed by a recess formed in facing and abutting surfaces of said cam cap and said cylinder head.

14. An internal combustion engine as set forth in claim 13, wherein the plurality of passages include longitudinally extending passages formed in the cam shaft for control fluid communication between the control valve and the hydraulically operated variable valve actuating mechanism.

15. An internal combustion engine as set forth in claim 14, wherein the control valve communicates with the cam shaft longitudinally extending passages through passages formed in at least one of the cylinder head member and the bearing cap member.

16. An internal combustion engine as set forth in claim 15, wherein at least one of the passages formed in at least one of the cylinder head member and the bearing cap member is not a drilled passage.

17. An internal combustion engine as set forth in claim 16, wherein the passage that is not drilled is the passage formed by the recess in the abutting face of one of the cylinder head member and the cam bearing cap.

18. An internal combustion engine as set forth in claim 17, wherein the passage that is not drilled is formed in the abutting face of the cam bearing cap.

19. An internal combustion engine as set forth in claim 18, wherein passages that terminate with the cam shaft longitudinally extending passages are all formed in the bearing cap member.

20. An internal combustion engine as set forth in claim 19, wherein at least one of the passages formed in at least one of the cylinder head member and the bearing cap member extends through said cylinder head member from an oil supply and terminates in a closed ended bore in said bearing cap member in which an oil filter is positioned and can be serviced by removing said bearing cap member.

21. An internal combustion engine as set forth in claim 20, wherein the variable valve actuating mechanism varies the timing between the cam shaft and the engine driven shaft.

* * * * *